US008616807B2

(12) United States Patent
Ogorchock

(10) Patent No.: US 8,616,807 B2
(45) Date of Patent: Dec. 31, 2013

(54) TWO-STAGE MECHANICALLY-STABILIZED RETAINING EARTH WALL AND METHOD

(76) Inventor: John M. Ogorchock, Montgomery, TX (US)

( * ) Notice: Subject to any disclaimer, the term of this patent is extended or adjusted under 35 U.S.C. 154(b) by 94 days.

(21) Appl. No.: 12/925,036

(22) Filed: Oct. 12, 2010

(65) Prior Publication Data

US 2012/0087742 A1 Apr. 12, 2012

(51) Int. Cl.
*E02D 29/02* (2006.01)

(52) U.S. Cl.
USPC ..... 405/262; 405/284; 405/258.1

(58) Field of Classification Search
USPC ..... 405/258.1, 262, 272, 284, 286, 302.4; 29/897.3, 897.32, 897.34, 525.01, 29/525.02; 248/200, 903; 403/206, 208, 403/396, 389
See application file for complete search history.

(56) References Cited

U.S. PATENT DOCUMENTS

| | | | | |
|---|---|---|---|---|
| 8,177,458 | B2 * | 5/2012 | Taylor | 405/262 |
| 2003/0223825 | A1 * | 12/2003 | Timmons et al. | 405/285 |
| 2009/0308005 | A1 * | 12/2009 | Ireland et al. | 52/250 |
| 2010/0247248 | A1 * | 9/2010 | Taylor | 405/262 |

* cited by examiner

*Primary Examiner* — Sean Andrish
(74) *Attorney, Agent, or Firm* — Polasek, Quisenberry & Errington LLP; C. Dale Quisenberry

(57) ABSTRACT

A two-stage retaining wall and related systems and methods are disclosed. The wall may include a welded-wire earth wall comprising a plurality of generally horizontal bars. The wall may include a foundation spaced apart from the welded-wire earth wall. The wall may include a plurality of concrete panels positioned on the foundation to form a concrete wall. Each concrete panel may include at least one pair of loop anchors disposed on a back face, wherein the back face faces the welded-wire earth wall. The wall may also include a plurality of connector assemblies, each of which may include a rebar hook and a threaded bar. The rebar hook is adapted for engagement with the generally horizontal bars on the welded-wire earth wall. A first end of the threaded bar may be threadably engaged with the rebar hook and a second end of the threaded bar may be adapted for connection to one of the pair of loop anchors. Each threaded bar is preferably connected to a pair of loop anchors on each of the concrete panels in a substantially horizontal plane.

1 Claim, 7 Drawing Sheets

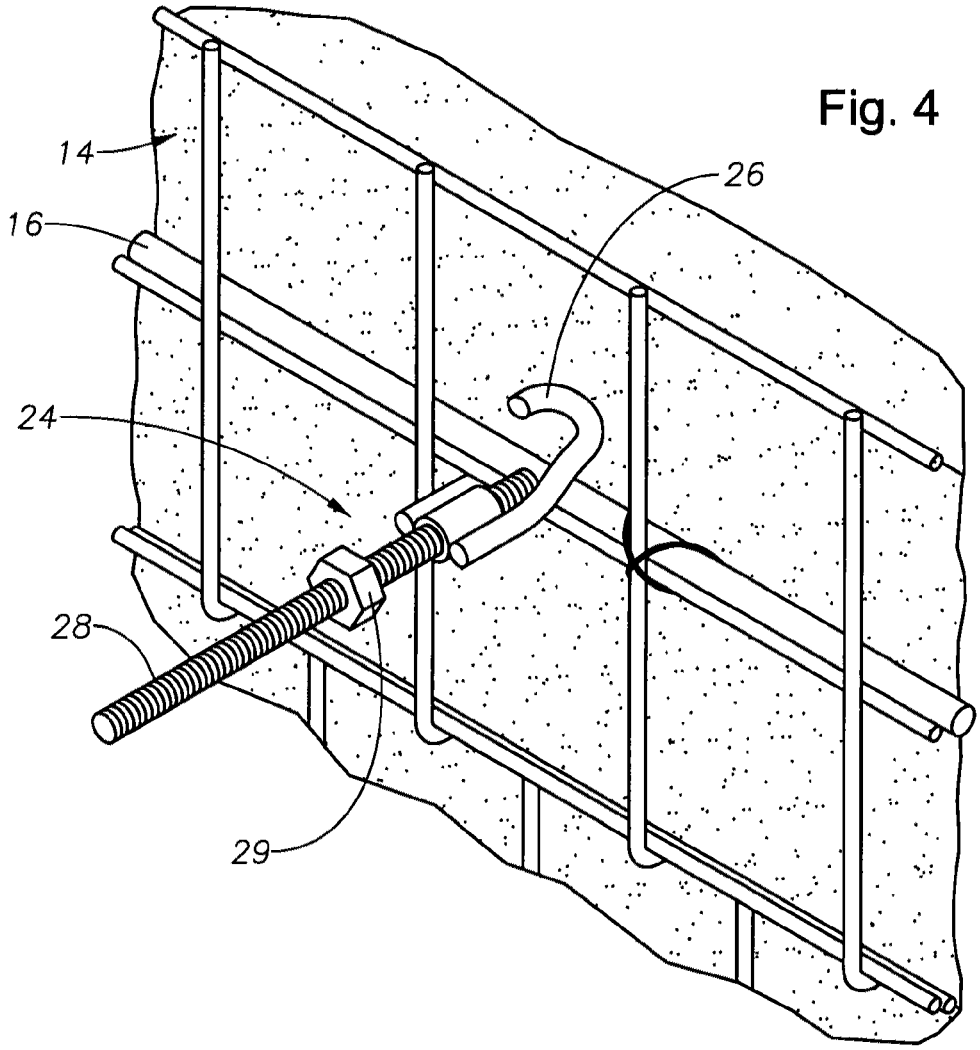
Fig. 4
Fig. 5
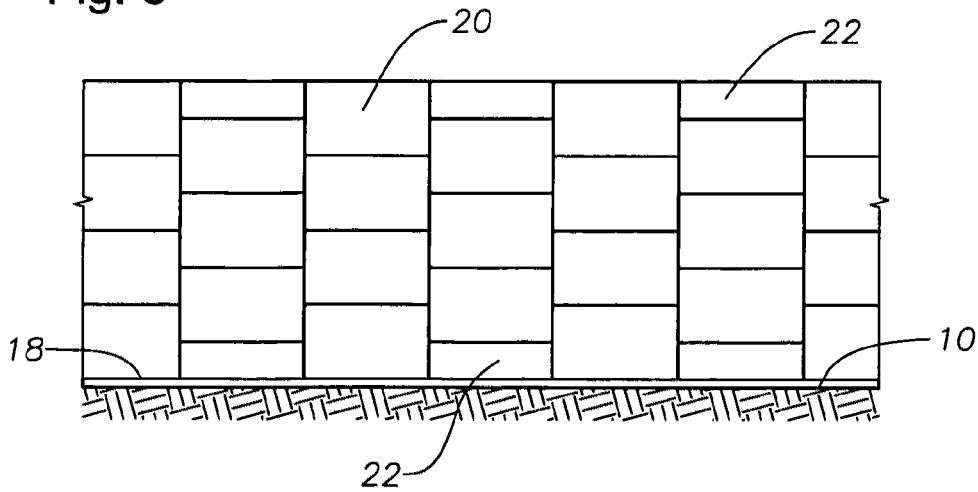

TWO-STAGE MECHANICALLY-STABILIZED RETAINING EARTH WALL AND METHOD

BACKGROUND OF THE INVENTION

1. Field of the Invention

The present invention generally pertains to retaining walls, and more particularly to two-stage mechanically-stabilized retaining earth walls and related methods wherein the first stage entails construction of an earth wall using weld-wire components in a known manner and the second stage entails attachment of pre-cast concrete panels through the use of a substantially horizontal connector in accordance with the present invention.

2. Description of the Related Art

It is known within a variety of fields to construct retaining walls for various purposes. Within the road construction industry, for example, it is known to erect temporary and permanent retaining walls for embankments, roadway supports, bridge abutments and the like. It is also known that these retaining walls can be constructed using a variety of techniques and materials, including, for example, concrete and/or welded wire components. An example of a precast modular wall panel is disclosed in U.S. Pat. No. 5,259,704 to Ogorchock. Examples of retaining walls constructed using welded wire components may be found in a number of U.S. patents, including, for example, U.S. Pat. No. 4,117,686 to Hilfiker, U.S. Pat. No. 4,329,089 to Hilfiker et al., U.S. Pat. No. 4,391,557 to Hilfiker et al., U.S. Pat. No. 4,505,621 to Hilfiker et al., U.S. Pat. No. 4,856,939 to Hilfiker, and U.S. Pat. No. 5,722,799 to Hilfiker.

The concept of a two-stage retaining wall is also known within the road construction industry. As mentioned above, two-stage retaining wall systems include a welded wire earth wall as the first stage and a precast concrete wall made from precast concrete panels as the second stage. Examples of such a two-stage wall system may be found in *Performance of Mechanically Stabilized Earth walls over compressible soils*, R. A. Bloomfield, A. F. Soliman and A. Abraham, The Reinforced Earth Company, Vienna, Va., USA, and also in U.S. Pat. No. 5,971,669 to Crigler. A serious drawback to the prior art, however, relates to the design and method by which the precast concrete panels are connected to the welded wire earth wall. More specifically, with respect to the Crigler '669 patent for example, once the welded wire wall is in place, and the precast concrete panels are individually positioned for connection to the welded wire wall, the workers use a connector assembly to connect the precast concrete panels to the welded wire wall. One of the big problems with the Crigler '669 design is that the connection point on the precast concrete panel is not at the same height as the corresponding connection point on the welded wire wall. As a result, the connector assemblies must be installed at an inclined angle as opposed to in the horizontal plane. This represents a serious design flaw as it fails to address the fact that the welded wire wall will continue to settle after the precast concrete panels are attached to the welded wire wall. As a result, when the welded wire wall settles, it will lower the end of the connector assembly that is spaced away from the precast concrete wall, thereby either pulling the precast concrete ball towards the welded wire wall or pushing it away from the welded wire wall, depending on whether the connector assembly is installed to be upwardly or downwardly inclined towards the precast concrete wall. For example, the connector assembly is shown in a downwardly installed configuration in FIG. 4*c* of the Crigler '669 patent.

As will become apparent from the following description and discussion, however, the present invention, which is also directed to two-stage retaining walls, provides an improved design that enables on-the-fly installation of a connector in a horizontal plane to thereby minimize the effect of later settling of the welded wire wall. In this manner, the various embodiments of the two-stage retaining walls and related systems and methods of the present invention overcome the deficiencies of the prior art and constitutes an improved and more cost-effective retaining wall in comparison to the walls and methods disclosed in the above-listed disclosures.

SUMMARY OF THE INVENTION

In one aspect, the present invention may be a two-stage retaining wall comprising: a welded-wire earth wall comprising a plurality of generally horizontal bars; a foundation spaced apart from the welded-wire earth wall; a plurality of concrete panels positioned on the foundation to form a concrete wall, each concrete panel including at least one pair of loop anchors disposed on a back face, the back face facing the welded-wire earth wall; and a plurality of connector assemblies, each connector assembly including a rebar hook and a threaded bar, the rebar hook being adapted for engagement with the generally horizontal bars on the welded-wire earth wall, a first end of the threaded bar being threadably engaged with the rebar hook and a second end of the threaded bar being adapted for connection to one of the pair of loop anchors, wherein at least one threaded bar is connected to a pair of loop anchors on each of the concrete panels in a substantially horizontal plane. Another feature of this aspect of the invention may be that each connector assembly further includes a first threaded nut, a second threaded nut, a first washer and a second washer, and the threaded bars are located between a pair of loop anchors and secured thereto with the loop anchors being secured between (a) the first threaded nut and first washer and (b) the second threaded nut and second washer. In yet another aspect of one embodiment of the invention, the wall may further include a bridging channel having a plurality of apertures, the bridging channel being connected between (a) a first pair of loop anchors on a first one of the concrete panels and (b) a second pair of loop anchors on a second one of the concrete panels that is adjacent the first one of the concrete panels.

Other features, aspects and advantages of the present invention will become apparent from the following discussion and detailed description.

BRIEF DESCRIPTION OF THE DRAWINGS

FIG. 4 is a perspective view of a connector used to attach the welded wire wall with the precast concrete wall.

FIG. 5 is a side view of a two-stage wall system once constructed and in place.

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DETAILED DESCRIPTION OF THE INVENTION

Figure 1:
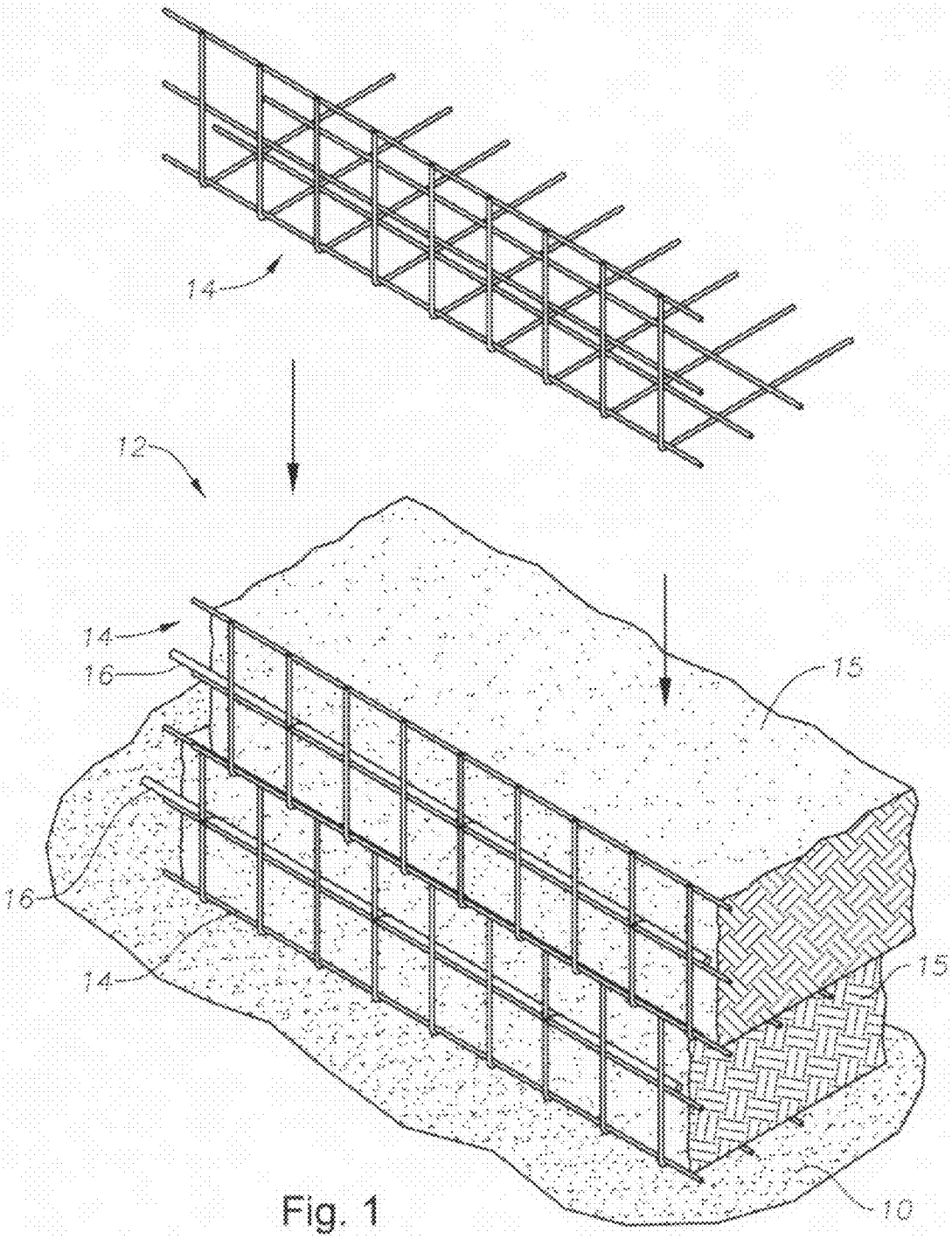
FIG. 1 is a perspective view of a welded wire wall in the process of being constructed.

Referring to the drawings in detail, wherein like numerals denote identical elements throughout the several views, and referring initially to FIG. 1, the first step in constructing a two-stage retaining wall on a section of graded earth 10 is to construct a welded wire wall 12. FIG. 1 illustrates the welded wire wall 12 in the process of being constructed. As can be seen in FIG. 1, the welded wire wall 12 is constructed in layers using L-shaped welded wire mats 14 in a known manner. As shown in FIG. 1, the first two layers of mats 14 have been positioned and back-filled with dirt 15, and the third level of the welded wire wall 12 is in the process of being installed. Each of the vertically upstanding sections of the L-shaped mats 14 is provided with a generally horizontal bar 16 (e.g., rebar), which may be manually attached (e.g., by wire) to a generally horizontal wire member of the upstanding mat sections during installation. The purpose and function of the horizontal bars 16 will be explained hereinbelow. It is generally preferred, depending on the soil condition of the construction site, to allow the welded wire wall 12 to settle for a period of time before moving on to construct the second stage of the two-stage retaining wall, i.e., attachment of the precast concrete wall panels, as mentioned above and discussed in more detail below.

Figure 2:
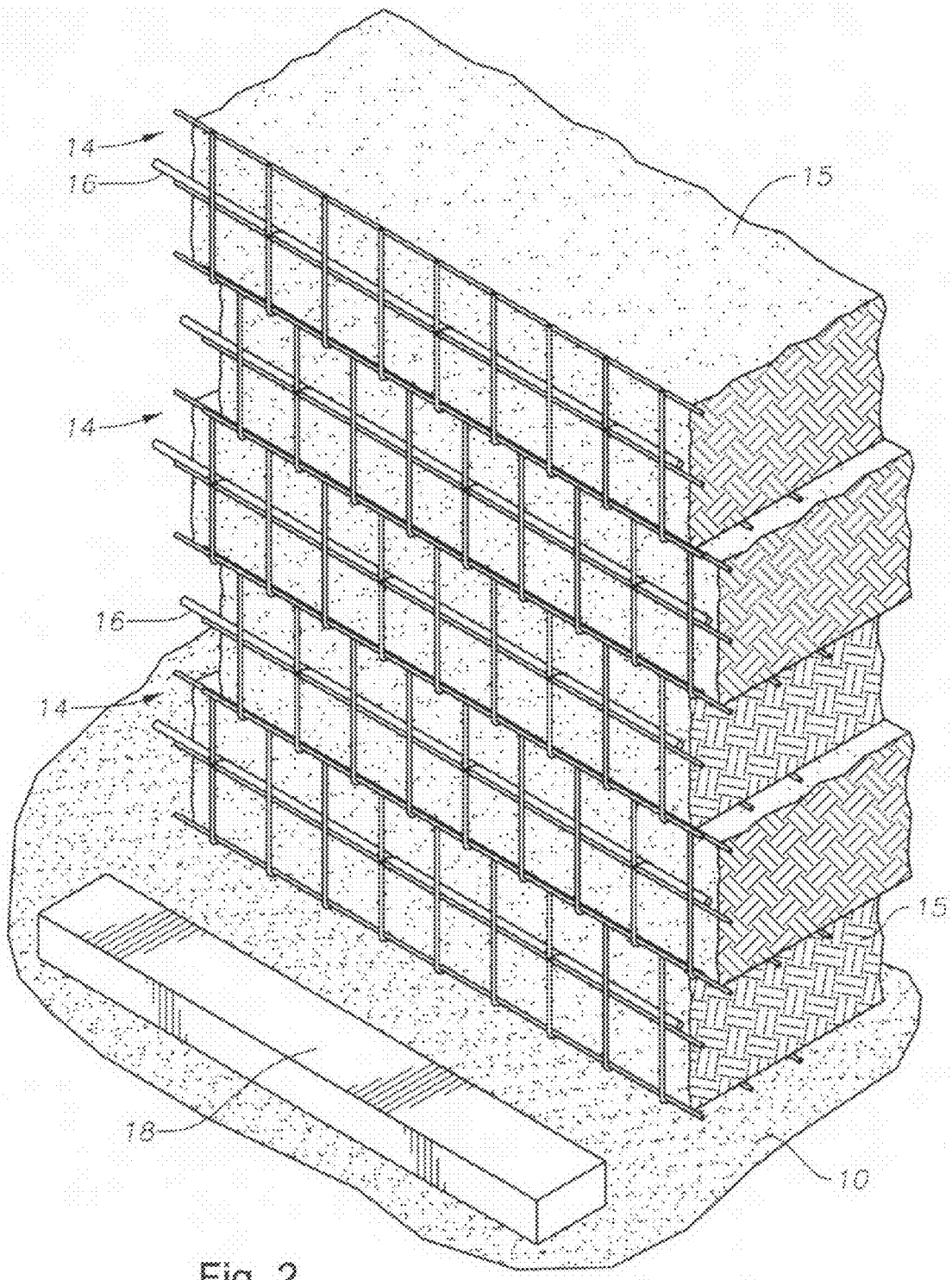
FIG. 2 is a perspective view of the welded wire wall shown in FIG. 1 after it has been completed, and with a foundation to support the second-stage precast concrete wall to be constructed positioned in front of the welded wire wall.

Referring now to FIG. 2, the welded wire wall 12 is shown after it has been completed. Once construction of the welded wire wall 12 has been completed and it has been allowed to settle, the next step is to commence construction of the second-stage precast concrete wall. The first step in this second stage is to pour a concrete foundation or leveling pad 18. Once the foundation 18 is in place, the process of building the precast concrete wall, and attaching it to the welded wire wall 12, can commence.

Figure 3:
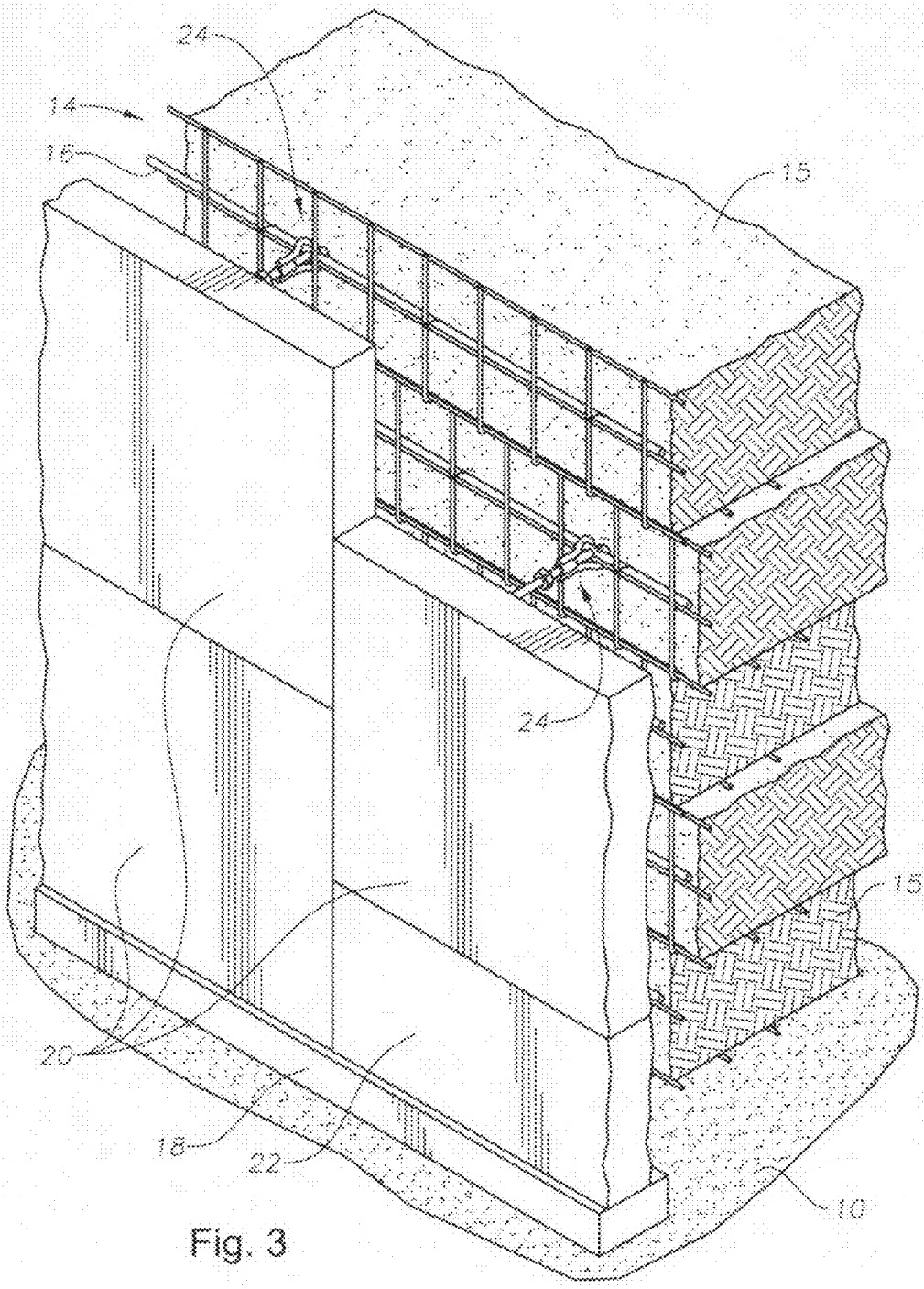
FIG. 3 is a perspective view of what is shown in FIG. 2 but additionally shows the second-stage precast wall in the process of being constructed on the foundation.

Referring now to FIG. 3, it can be seen that the precast concrete wall is preferably constructed using two sizes of precast concrete panels, one being a large or standard-sized panel 20 and the other being a small panel 22 that is preferably half the height of the large panels 20. In the example shown in FIG. 3, three large panels 20 and one small panel 22 have been positioned and attached to the welded wire wall 12. It can also be seen from FIG. 3 that the panels 20 and 22 have been connected to the welded wire wall 12 using connector assemblies 24, and that those connector assemblies 24 are connected in a generally horizontal plane, as opposed to in an upwardly or downwardly inclined plane.

Figure 6:
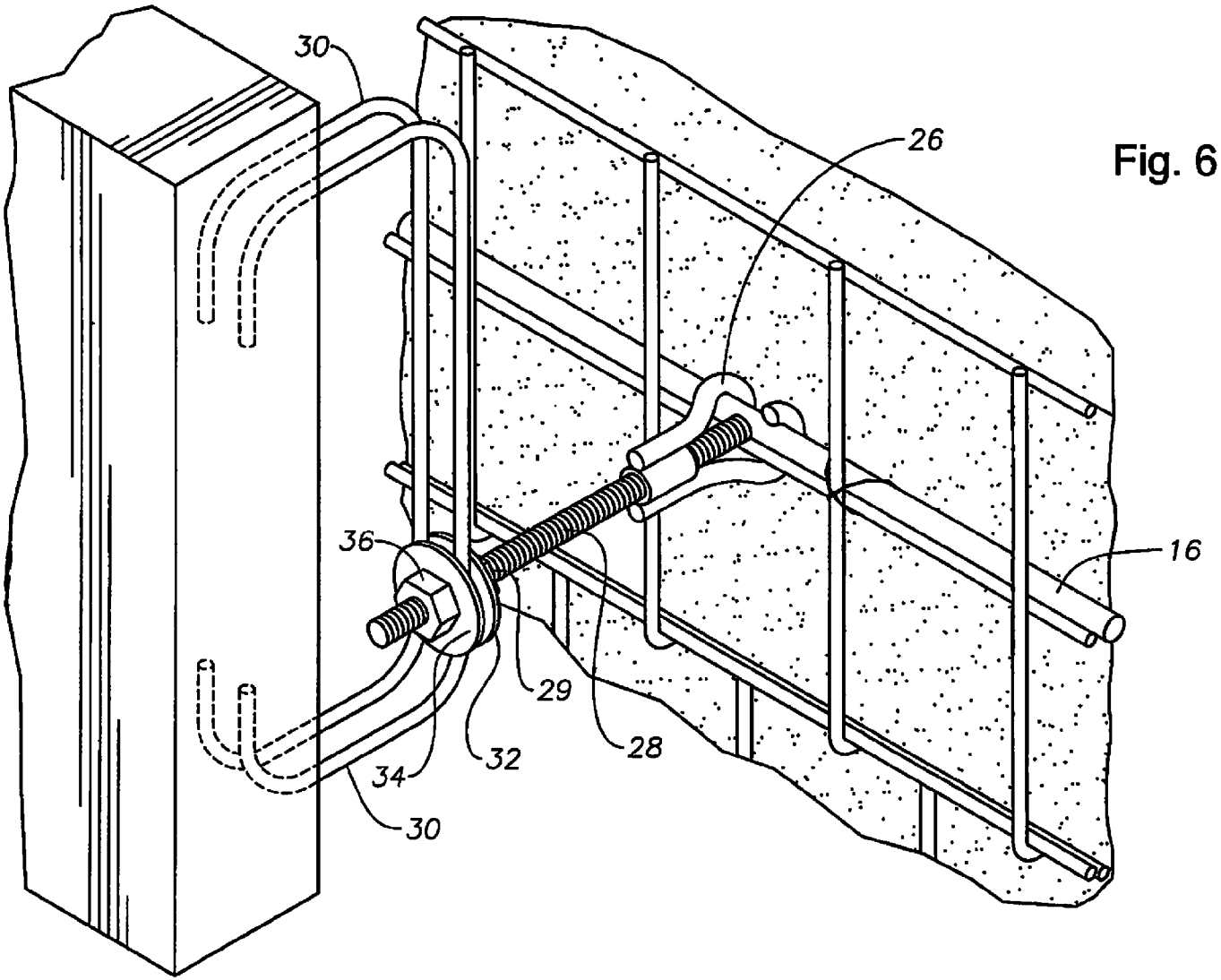
FIG. 6 is a perspective view showing the manner in which loop anchors are embedded in the precast concrete wall panels, and how the hook connector attaches to the loop anchors.

With reference to FIG. 4, it can be seen that in a specific embodiment each connector assembly 24 may include a threaded rebar hook 26 and a threaded rod 28 that is shown threadably attached to the rebar hook 26. The assembly 24 may also include a first nut 29 that is shown threaded onto the threaded rod 28, the purpose of which will be explained below. The rebar hook 26 may be a Steel Dog® RH-6 Rebar Hook made by Titcomb Bros. Mfg. of Sandwich, Mass. (see http://steel-dog.com/RH_RebarHool.html, incorporated herein fully by reference). To attach the hook 26 to the rebar 16, the hook 26 is first pushed onto the rebar 16 while the threaded rod 28 is in a retracted position, the hook 26 is then twisted or rotated 90 degrees and pulled tight so that the hooks are firmly hooked over the rebar 16, and then the threaded rod 28 is tightened until the end of the threaded rod 28 rests firmly against the rebar 16. With reference to FIG. 6, it is noted that the worker who is attaching the rebar hook 26 to the wire wall 12 will do so once the next concrete panel 20 or 22 is positioned, and the worker will position the rebar hook 26 on the rebar 16 at a location lined up with the corresponding pair of loop anchors 30 that are embedded in the back faces of the concrete panels, 20 or 22 as shown in FIG. 7.

As shown in FIG. 6, once the rebar hook 26 is connected to the rebar 16, the next step is to connect the other end of the threaded rod 28 to the precast panel 20 or 22, and to do so such that the threaded bar 28 is positioned substantially horizontally. This is accomplished by connecting the threaded rod 28 to the pair of loop anchors 30 through the use of first and second washers 32 and 34, and the first and second nuts 29 and 36. The first washer 32 is first placed over the threaded rod 28 and the threaded rod is then positioned between the pair of loop anchors 30. The first washer 32 is slid along the threaded bar 28 by rotating the first nut 29 until the first washer 32 comes into contact with the loop anchors 30. The second washer 34 is then slid over the end of the threaded bar 28 and into contact with the loop anchors 30 such that the loop anchors 30 are disposed between the first and second washers 32 and 34. The nut 36 is then threaded onto the end of the threaded bar 28 and tightened firmly against the second washer 34 such that the loop anchors 30 are secured between the first and second washers 32 and 34, which are forced towards one another by the first and second nuts 29 and 36.

Figure 7:
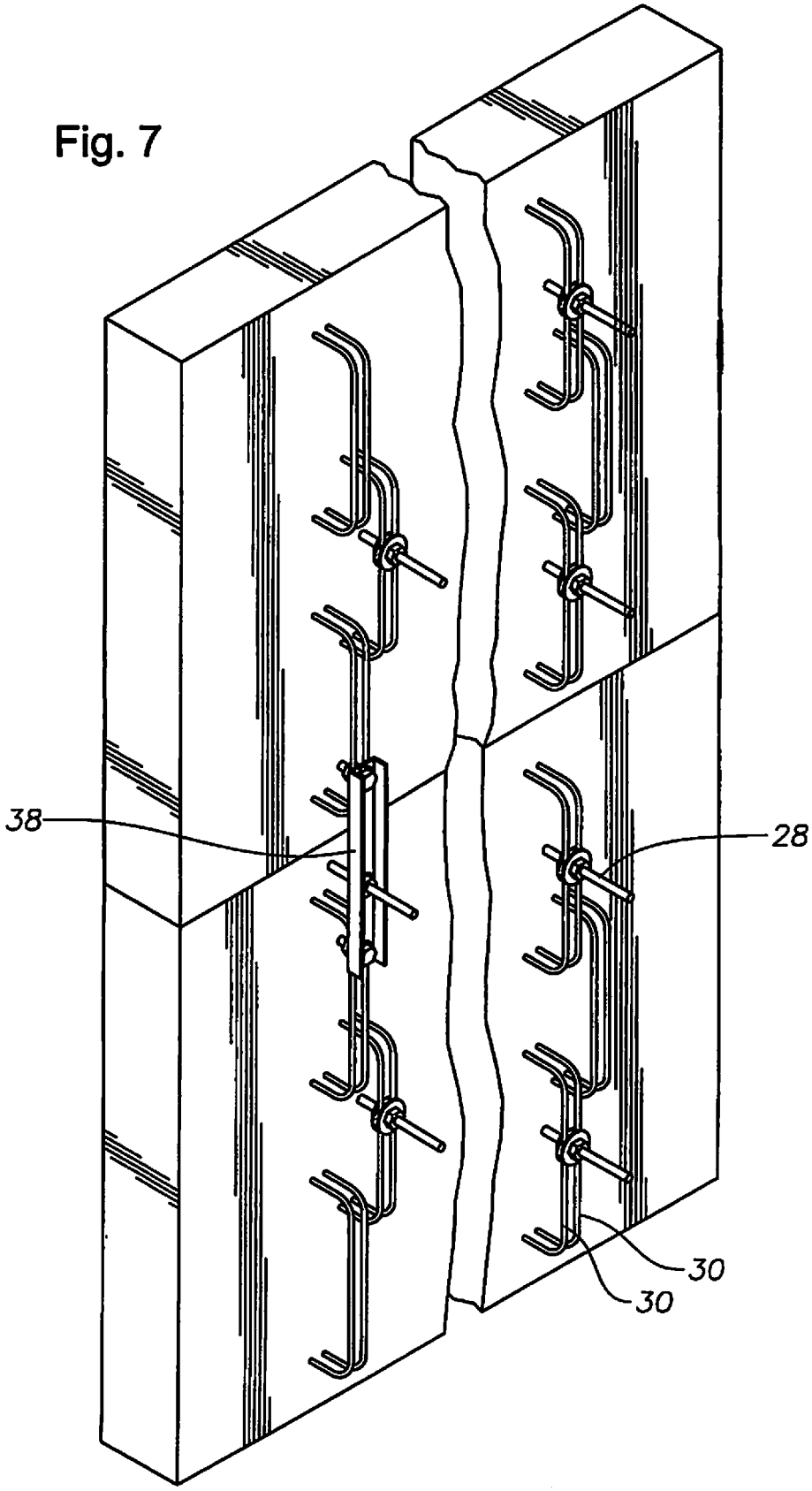
FIG. 7 is a perspective view of the back faces of the precast concrete wall panels and showing how numerous pairs of loop anchors are embedded in the wall panels in aligned and staggered fashion.
Figure 8:
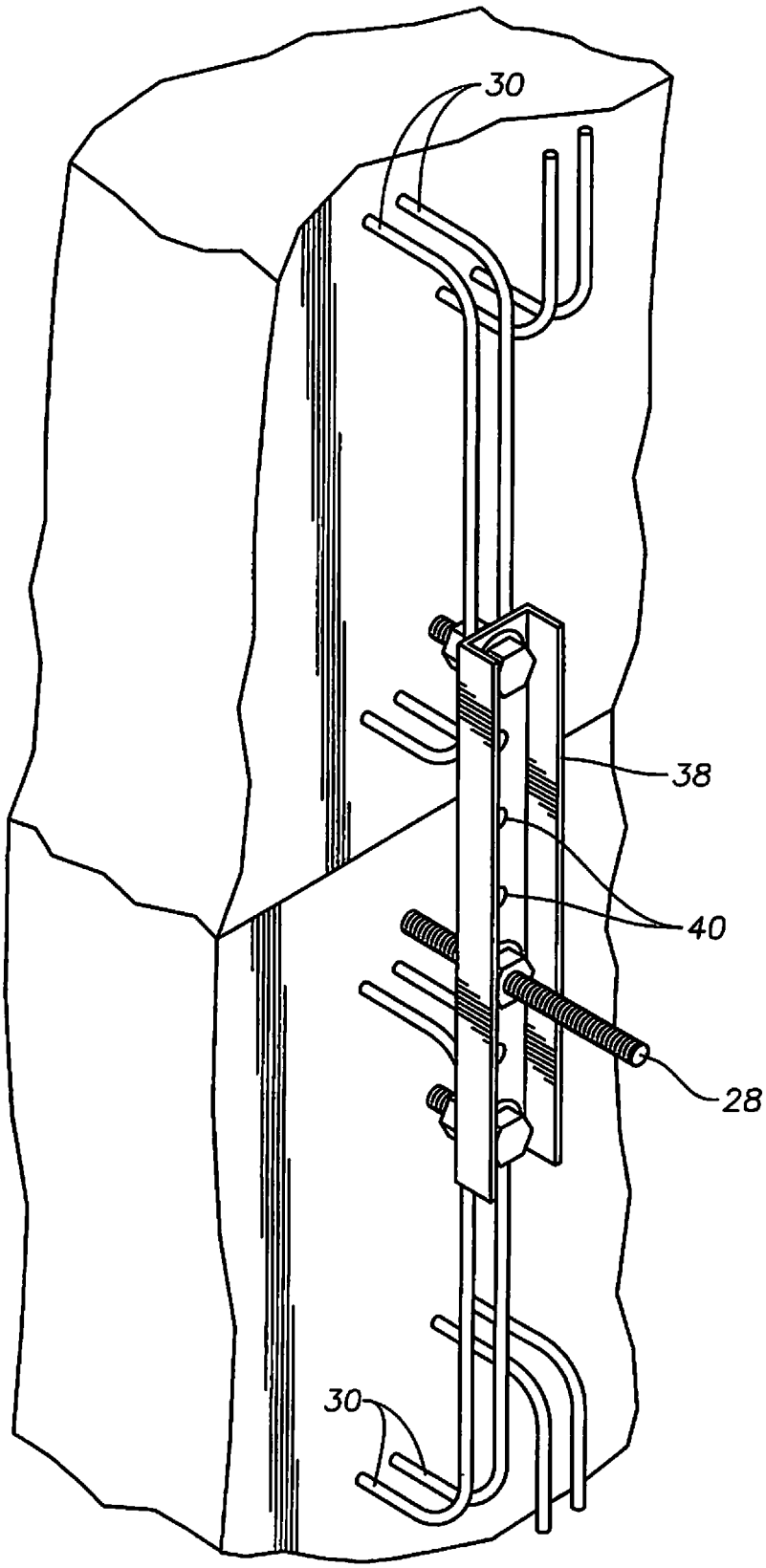
FIG. 8 is a enlarged perspective view of a portion FIG. 7 and illustrated how a bridging channel is connected between adjacent pairs of loop anchors to allow for connection points therebetween.

As shown in FIGS. 7 and 8, it may be desirable to position a connector assembly 24 such that when horizontal it will line up with a joint where two concrete panels 20 or 22 abut one another. Since there will not be a pair of loop anchors 30 in that region, a bridging channel 38 may be connected between two sets of loop anchors 30 on adjoining concrete panels 20 or 22. The bridging channel 38 may be provided with a plurality of apertures 40 through which the threaded rods 28 of the connector assemblies 24 may be connected. In this manner, the use of bridging channels 38 may provide connecting points for the connector assemblies 24 in the event that the horizontal position of the threaded rods 28 falls in the region between two pairs of anchor loops 30 on adjoining concrete panels 20 or 22. Similarly, as shown in FIG. 7, pairs of anchor loops 30 may be embedded in a staggered overlapping configuration to provide connecting points all along the height of the concrete panels 20 or 22.

Note that one of the advantages of the system and method described herein over the prior art is that the workers can make the connections from outside of the panels 20 or 22. Stated differently, the workers do not have to be in between the wire wall 12 and the precast wall panels 20 or 22 in order to build the second-stage wall, as done in the prior art. As such, use of the systems and methods described and claimed herein are safer than with the prior art. Also, as explained above, a key advantage of the disclosed and claimed systems and methods is the ability to install the connector assemblies in a horizontal configuration.

It is to be understood that the invention is not limited to the exact details of construction, operation, exact materials or embodiments shown and described, as obvious modifications and equivalents will be apparent to one skilled in the art. Accordingly, the invention is therefore to be limited only by the scope of the appended claims.

The invention claimed is:

1. A two-stage retaining wall comprising:

a welded-wire earth wall comprising a plurality of generally horizontal bars;

a foundation spaced apart from the welded-wire earth wall;

a plurality of concrete panels positioned on the foundation to form a concrete wall, each concrete panel including at least one pair of loop anchors disposed on a back face, the back face facing the welded-wire earth wall;

a plurality of connector assemblies, each connector assembly including a rebar hook and a threaded bar, the rebar hook being adapted for engagement with the generally horizontal bars on the welded-wire earth wall, a first end of the threaded bar being threadably engaged with the rebar hook and a second end of the threaded bar being adapted for connection to one of the pair of loop anchors, wherein at least one threaded bar is connected to one of the pair of loop anchors on each of the concrete panels in a substantially horizontal plane, and a bridging channel having a plurality of apertures, the bridging channel being connected between (a) a first pair of loop anchors on a first one of the concrete panels and (b) a second pair of loop anchors on a second one of the concrete panels that is adjacent the first one of the concrete panels.

* * * * *